United States Patent [19]

Mayhew et al.

[11] Patent Number: 4,894,974

[45] Date of Patent: Jan. 23, 1990

[54] STRUCTURAL INTERLOCK FRAME SYSTEM

[75] Inventors: David Mayhew, Hollister; E. Nolan Scheid, Morgan Hill, both of Calif.

[73] Assignee: Walter J. Jaworski, Cupertino, Calif.

[21] Appl. No.: 215,080

[22] Filed: Jul. 5, 1988

[51] Int. Cl.[4] ..... E04C 2/54

[52] U.S. Cl. ..... 52/785; 52/807; 52/668

[58] Field of Search ..... 52/284, 807, 785, 309.11, 52/668, 92, 93

[56] References Cited

U.S. PATENT DOCUMENTS 2,055,339 9/1936 Dalton ..... 52/807

3,462,897 8/1969 Weinrott ..... 52/309.11

FOREIGN PATENT DOCUMENTS 270480 11/1950 Switzerland ..... 52/785

*Primary Examiner*—James L. Ridgill, Jr.

*Attorney, Agent, or Firm*—Majestic, Parsons, Siebert & Hsue

[57] ABSTRACT

A structural panel for use in building construction and other applications has an internal rib structure with the ribs interlocked to form a two dimensional matrix. The ribs have tabs that are fitted into openings of facing sheets of the panels. This structure results in a strong prefabricated building panel.

5 Claims, 3 Drawing Sheets

STRUCTURAL INTERLOCK FRAME SYSTEM

BACKGROUND OF THE INVENTION

This invention relates generally to a structural panel, and particularly to such a panel for use as a modular wall unit in a building.

A typical structure for a wall in a building utilizes wooden (or sometimes metal) uprights (studs) spaced at intervals, which are connected at the ceiling and floor. These uprights are then covered with wall panels or facing of any of a wide variety of types, such as dry wall board, plywood, and the like. The wall panels are attached to the uprights by means of nails or glue.

As an alternative to building the walls at the building site in this manner, prefabricated wall units may be formed off site and then assembled to form the building. An internal structure of each such unit is covered with an appropriate facing. When such units are being transported or put into place in the building structure, it is common that they undergo considerable forces and torques, the resulting stresses weakening the units. Many existing prefabricated wall units are not strong enough to withstand such handling without being damaged. Additionally, because of this lack of strength, many such units require that considerable additional structure be used when they are installed into a building.

Therefore, it is a primary object of the present invention to provide an improved structural interlock frame system and panels therefore that have a particularly high strength and resistance to deformation.

It is another object of the present invention to provide such a system which is well suited for use as modular walls in a building.

It is a further object of this invention to provide such a system which requires a minimum of additional framing or other structural strength when installed to form a portion of a building.

SUMMARY OF THE INVENTION

These and additional objects are accomplished by the present invention, wherein, generally and briefly, a prefabricated building panel is provided with a pattern of interlocking internal cross ribs, with tabs provided where the ribs cross and interlock to protrude through matched openings in sheet material used to face the panel. This structure minimizes adverse effects of external forces on the panel during transportation and installation, as well as providing a stronger resulting building without the need for extensive additional structural beams or other elements. Additionally, the panel is provided with edge slots that make it easy to attach the panels to each other and/or to other building structural elements.

Additional features, objects and advantages of the present invention are provided as part of the following description of its preferred embodiments, which description should be taken in conjunction with the accompanying drawings.

DESCRIPTION OF THE PREFERRED EMBODIMENTS

Figure 1:
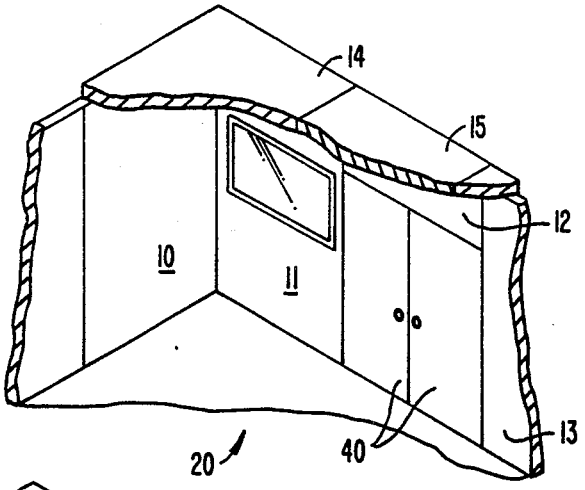
FIG. 1 is a representation of a building using a plurality of prefabricated modular panels that are constructed and according to the present invention.

FIG. 1 shows an example use of the structural interlocking construction panels of the present invention to form a portion 20 of a building. A construction panel or unit 10 without any openings is attached at a corner to a panel 11 that includes a window. A door 40 is framed by the panel 11 and another panel 13, and includes a standard door header 12. In addition to use in forming a wall, the same construction panel can be installed in a ceiling or as a roof, such as shown with additional panels 14 and 15.

Figure 2:
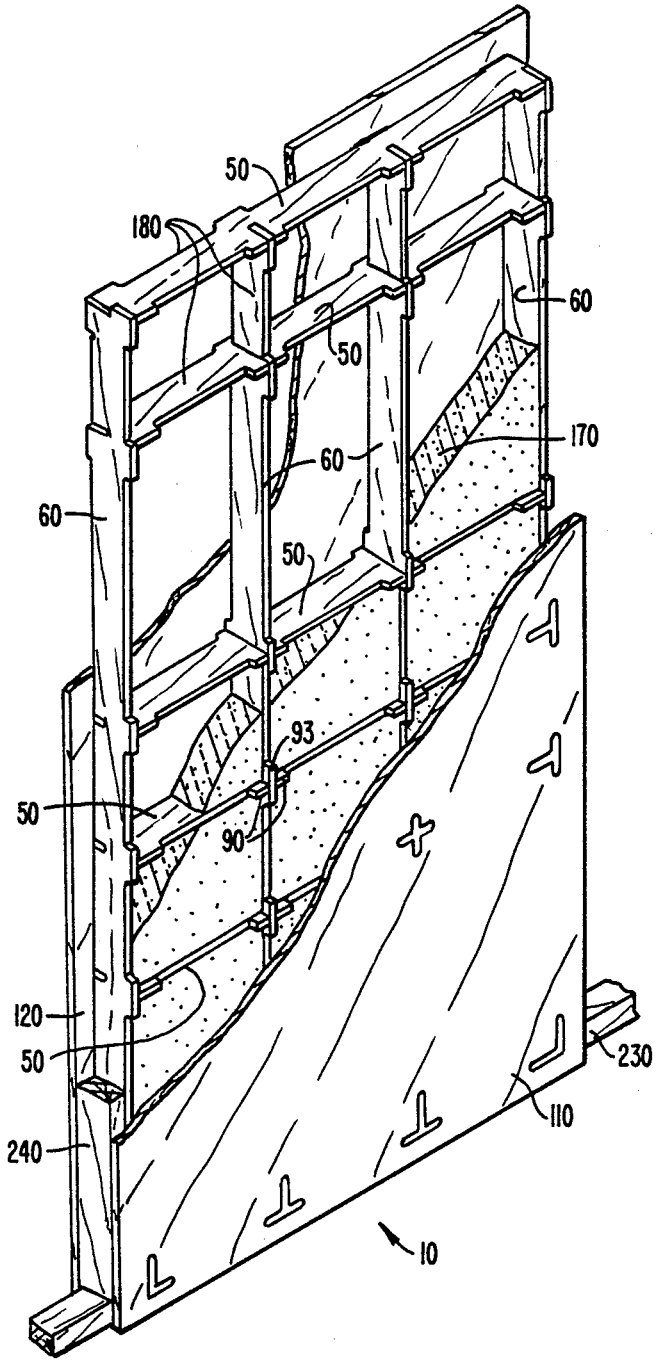
FIG. 2 is a perspective view, partially cut away, showing a single construction panel of the building portion of FIG. 1.

FIG. 2 shows a single modular wall unit 10, partially cut away to show the structure of the invention. The unit 10 includes at least one, and preferably several, ribs 50 extending in one direction, that direction being horizontal in a wall panel. Also included is at least one, and preferably several, ribs 60 extending in another direction, that direction being vertical in a wall panel. Cross-ribs 50 and 60 may be disposed at other angles for particular applications but an orthogonal relationship is typical for a rectangular panel, the ribs 50 being parallel to each other and the ribs 60 being parallel to each other. Ribs 50 and 60 will typically be formed from wood, although for a given material the advantages of the panel structure remain, regardless of the material chosen.

Figure 3:
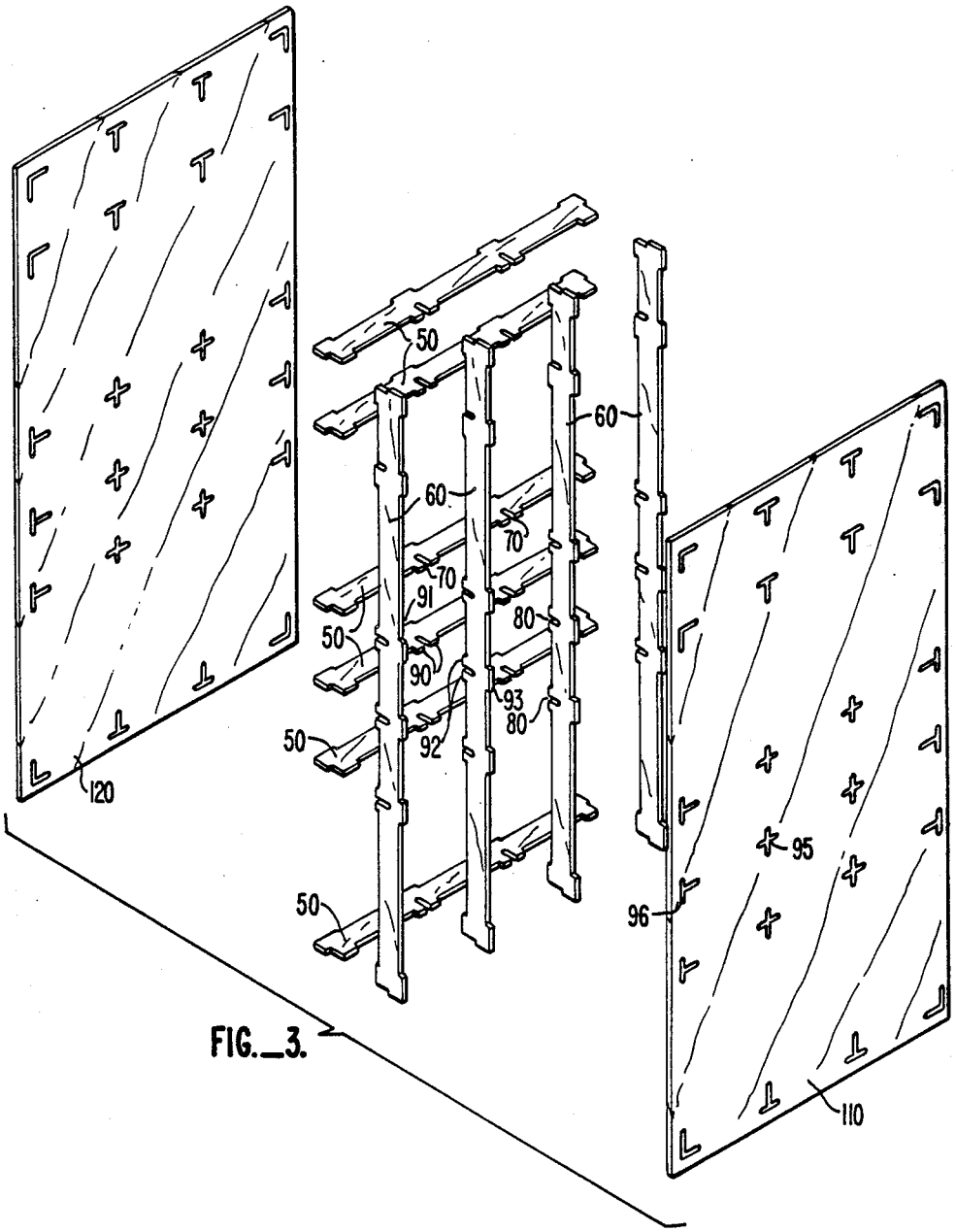
FIG. 3 is an exploded view of the construction panel of FIG. 2.

As shown in FIG. 3, ribs 50 include indentations 70 at intervals along the length thereof. The number of indentations 70 will depend upon the number of vertical ribs 60 utilized. Likewise, ribs 60 include indentations 80 along the length thereof. The pattern and locations of the indentations 70 and 80 are provided so that the ribs 60 and 70 interlock with one another. The horizontal ribs 50 and vertical ribs 60 are attached together in a twodimensional matrix by aligning their respective mating indentations 70 and 80, and sliding the ribs together to cause the indentations to interlock with one another. An appropriate fastening material, such as glue, is used hold these pieces together.

In order to provide an interconnection between the internal ribs 50 and 60 and outer layers 110 and 120, the ribs include protrusions that are captured by slots in the layers 110 and 120. This structure makes the resulting panel very strong and resistant to the effects of twisting and sharp impact forces on it. Ribs 50 include tabs 90 on one edge, which preferably are disposed on opposite sides of each slot 70, and a tab 91 on an opposite rib edge. Similarly, ribs 60 include tabs 92, which are disposed on opposite sides and immediately adjacent to each indentation 80, and tab 93 on an opposite rib edge. The result, when the ribs are attached together, is a cross shaped tab element formed from the tab components of both ribs that are joined at that point. Each such composite tab element is received by an appropriately positioned slot in the outside layers 110 and 120, such as slot 95, that closely conforms to the shape of the composite tab for a tight fit. At the edges of the panel, the corresponding tab elements and receiving slots are "T" shaped, such as indicated by slot 96. The outside panels are preferably attached to the ribs by the additional use of glue at at least the interconnections with the rib tabs. The use of glue on all the rib edges helps spread the stress evenly over the entire building component and not be concentrated in one area. The slots 95 and 96 in the layers 110 and 120 preferably extend completely through the layers, but could alternatively extend only part way therethrough from their inside surfaces. The outside layers 110 and 120 are preferably plywood sheets in a wood built unit but can alternatively be made of other materials.

This invention has several features which result in greatly improved strength and rigidity. First, the use of cross-beams or ribs 50 in conjunction with the vertical ribs 60 is a feature not found in standard wall units, which either lack horizontal ribs altogether, or simply utilize short horizontal studs which are limited in length by the distance between adjacent vertical ribs, and are simply nailed (or "toe-nailed") in place. Unit 10 of the present invention, by way of contrast, allows horizontal ribs of any desired length to be utilized, and indeed the preferable embodiment includes ribs 50 extending the entire width of the unit 10. Because of the interlocking indentations 70 and 80 at each junction of the ribs 50 and 60, this invention provides numerous points at which any force external to the unit 10, especially twisting forces or torques, will be resisted, and provides great strength to the system. In addition to this, the use of the rib tabs interlocking with the slots in the outside panels 110 and 120, virtually eliminates the possibility of any deformation of the unit 10 in construction use. While other configurations are possible, including embodiments where the tabs portions of intersecting ribs do not overlap, the cross-shaped overlap of the tabs shown in FIGS. 2 and 3 provides a great deal of strength and rigidity relative to the complexity of the design, and in particular provides resistance to deformation in all three dimensions. This results in the panel satisfying many shear wall requirements for earthquake protection, without something having to be specially built on site.

Figure 4:
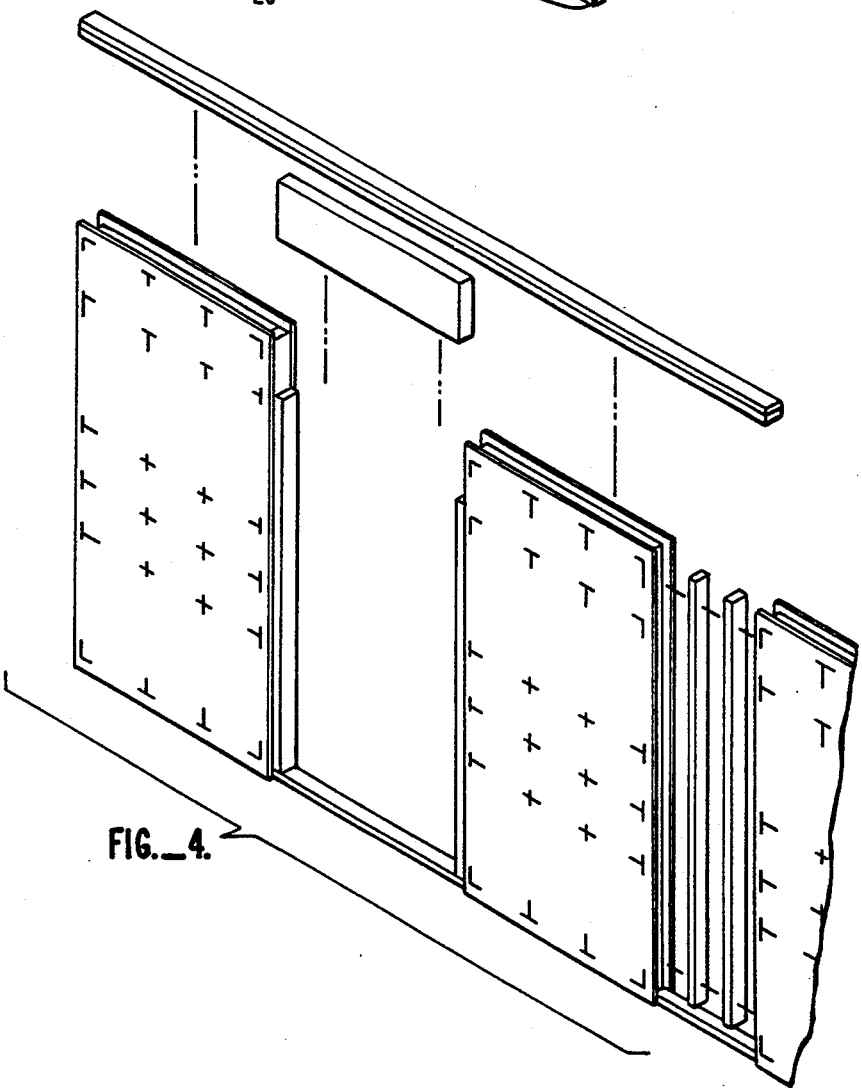
FIG. 4 illustrates an example building wall made of a plurality of construction panels of the type shown in FIGS. 2 and 3.

As shown in FIG. 2, the outside panels 110 and 120 may be configured to overlap the lower edge of the internal rib frame, in order to accommodate a sill plate 230 which is typically used in housing construction. The overlapped portion of the panels may be affixed to the sill plate 230 in a standard manner, and thus the present invention is suitable for use in conventional building arrangements. In addition, there may be overlap of the panels 110 and 120 along the vertical edges and the top of the rib frame, as shown in FIGS. 3 and 4, for similarly accommodating top beams to position and hold in place the panel 10. Similarly, such overlap can be provided along the sides.

Another advantage of the panel structure described is that its strength means that structural attachment and support is needed less often along the length of a building wall. However, it is generally preferred to install the panels with at least one vertical stud therebetween that is fastened to the rest of the building, such as the stud 240. Each panel is conveniently made to be approximately eight feet high and four feet wide. The horizontal rib 50 that is closest to the top rib is provided at a position that allows a panel having the portion above it removed in the field to be a useful height.

Typically, the frame of a house, office building or other structure will be commenced, while wall units incorporating the present invention will be prefabricated (either custom-built or in standard designs) in a workshop removed from the construction site. A unit 10 is inserted as necessary over the sill plate 230, and frame verticals 240 are then fixed in place in a standard manner. Numerous sizes and shapes of such units are, of course, possible, and windows, doors, or other necessary building features may easily be incorporated into the units. Additional units 10 are then installed, and in effect the frame of the building is built up around the modular units 10. FIG. 4 illustrates an example of a wall being built in this manner, with a door or large window being framed between two such panels. After the wall units of one floor are in place, horizontal support beams may be laid across the top ribs in the slot provided. The units 10 are strong enough that they may even be utilized as prefabricated floors, with only changes in the dimensions of the materials used being necessary to accommodate this function. Special-purpose units 10 are also quite useful for roofing with considerable strength advantage over standard roofs. Thus, a particularly strong and deformation-resistant frame is provided without the necessity for extensive on-site building.

The structural unit 10 has many advantages that make it particularly useful for constructing housing quickly and for forming emergency shelters. The panel units are easy to assemble without need for special tools, are easy to ship to the building site, are fire resistant and fully insulated, and are easily disassembled for reuse. The rib system creates a natural fire block inside the wall without having to specially and such blocks.

The increased strength achieved by the present invention is such that frames incorporating this design are useful in a variety of applications not practicable to date. For instance, in construction work it is typical to lay a cement foundation or supporting walls by the use of a steel frame, which of course has high strength for a given size. However, the panel design described herein may be used in constructing a wooden frame with sufficient strength for use as a cement form, and at the same time has the advantages over steel of light weight and being made from inexpensive, renewable materials. It will be appreciated that virtually any dimensions of the ribs 50 and 60 and panels 110 and 120 may be used, depending upon the purpose for which the unit 10 is used.

Another valuable use for the present invention is in floating dock systems. Because of the high strength and rigidity of the system, a dock unit of a given size will tolerate greater weight and stress than earlier systems. These units may be built in place, and filled with styrofoam or other flotation material 170 in the interior voids of the panel. In usual building applications, the material 170 is chosen for its thermal or acoustic insulation properties. For similar reasons, the unit 10 is useful as a shipping package or pallet, or as office partitions (with acoustic insulation in the gaps 160), or in many other uses where added strength and rigidity, combined with the usefulness of modular or prefabricated construction, are desired. Other applications include use as a sound barrier along highways, airports and the like, and use as a temporary shield around construction or demolition areas.

Although various specific examples of the present invention have been described, it will be understood that the invention is entitled to protection within the full scope of the appended claims.

It is claimed:

1. A structural interlock frame system, comprising:

at least one first rib having at least one tab along one edge thereof;

at least one second rib for positioning at an angle with respect to said first rib to form a skeleton for the frame system with said first and second ribs connected at a junction, said second rib having at least one tab along one edge thereof;

means for fastening said first rib to said second rib at said junction, said fastening means including indentations in each of said first and second ribs, with said indentations being positioned on said first and second ribs, respectively, so as to register with one another at said junction;

a wood panel having a slot that receives said tabs in a manner to attach it to said ribs, thereby providing strength and rigidity to the frame system, said slot being of a depth such that said tabs form a substantially flush surface with said panel when said tabs are inserted therein; and adhesive for fastening said panel to said junction of said first and second ribs, thereby distributing stress over the entire frame system.

2. A frame system as defined in claim 1, including plurality of said first ribs disposed substantially parallel to one another, and a plurality of said second ribs disposed substantially parallel to one another, with each of said first and second ribs including a plurality of said first and second tabs and a plurality of said first and second indentations, respectively, for forming said skeleton in the form of a matrix when said second ribs are attached to said first ribs.

3. A structural interlock frame system, comprising:

at least one first rib having at least one tab along one edge thereof;

at least one second rib for positioning at an angle with respect to said first rib to form a skeleton for the frame system with said first and second ribs connected at a junction, said second rib having at least one tab along one edge thereof;

means for fastening said first rib to said second rib at said junction, said fastening means including respective first and second indentations in each of said first and second ribs, with said indentations being positioned on said first and second ribs, respectively, so as to register with one another at said junction;

said first indentation being disposed in said first tab;

said second indentation being formed on an edge of said second rib at a point substantially opposite said second tab, such that said first and second tabs form a substantially flush surface when said first and second indentations are interlocked; and a panel having a slot that receives said tabs in a manner to attach it to ribs, thereby providing strength and rigidity to the frame system.

4. In a building having a walls, a structural frame system for the walls, comprising:

a plurality of substantially horizontal first ribs, each of said first ribs including a plurality of first tabs along an edge thereof, each of said first tabs having an indentation formed therein;

a plurality of substantially vertical second ribs, each of said second ribs including a plurality of second tabs along an edge thereof, and including a plurality of second indentations formed along an edge and at positions substantially opposite said second tabs, said second ribs attached to said first ribs by interlocking of said second indentations with said first indentations for forming a skeletal matrix having gaps for receiving insulating or other material, with said second indentations being of a depth sufficient to allow said first and second tabs to form a substantially flush surface when said skeletal matrix is assembled, said flush surface being defined by a plurality of pairs of said first and second tabs;

a first panel attached to skeletal matrix, said first panel having shape conforming to said flush surface and including a plurality of slots, each slot for receiving one of said pair of first and second tabs in a tight-fitting fashion for providing strength and resistance to twisting or other deformation of said frame system; and a second panel attached to said skeletal matrix opposite said first panel, for forming a modular wall unit.

5. A structural frame system as defined in claim 4, wherein said panels are configured to overlap the edges of said skeletal matrix, for attachment to a building frame.

* * * * *

UNITED STATES PATENT AND TRADEMARK OFFICE

CERTIFICATE OF CORRECTION

PATENT NO. : 4,894,974

DATED : JANUARY 23, 1990

INVENTOR(S) : DAVID MAYHEW, ET AL

It is certified that error appears in the above-identified patent and that said Letters Patent is hereby corrected as shown below:

Column 6, line 10, in Claim 3: insert --said-- after the word to (second occurrence)

Column 6, line 12, in Claim 4: delete "a" after the word having

Column 6, line 32, in Claim 4: insert --said-- after the word to

Signed and Sealed this

Twenty-second Day of May, 1990

*Attest:*

*Attesting Officer*

HARRY F. MANBECK, JR.

*Commissioner of Patents and Trademarks*